United States Patent [19]

El-Ibiary

[11] 4,340,087

[45] Jul. 20, 1982

[54] POWER TRANSMISSION

[75] Inventor: Yehia El-Ibiary, Troy, Mich.

[73] Assignee: Sperry Corporation, Troy, Mich.

[21] Appl. No.: 179,947

[22] Filed: Aug. 21, 1980

[51] Int. Cl.[3] ..... F15B 13/043

[52] U.S. Cl. ..... 137/625.64; 91/420; 137/596.1; 137/596.17

[58] Field of Search ..... 91/420; 137/596.1, 596.17, 137/625.64

[56] References Cited

U.S. PATENT DOCUMENTS 3,289,701 12/1966 Booth et al. ..... 137/596.17 X

*Primary Examiner*—Gerald A. Michalsky

*Attorney, Agent, or Firm*—Barnes, Kisselle, Raisch & Choate

[57] ABSTRACT

An electrically controlled hydraulic remote controller for use in piloting the operation of a hydraulic control valve comprising a pair of electrically operated three-way pressure control valves. Each control valve has a supply pressure inlet and a controlled pressure outlet operable in the de-energized position to prevent flow from the supply inlet to said controlled pressure outlet and connect said outlet to tank pressure. Each valve when energized is operable to permit fluid flow from the inlet to the controlled pressure outlet in proportion to the solenoid force operating said valve and simultaneously permit fluid to flow to tank pressure. The controller is responsive to the higher of the controlled pressure of the outlets of the two pressure controlled valves for applying the higher controlled pressure to the valve having the lower controlled pressure to operate the valve in direction increasing the passage of fluid through the other valve to tank.

20 Claims, 4 Drawing Figures

POWER TRANSMISSION

This invention relates to power transmission and particularly to pilot pressure operated hydraulic systems which utilize remote controllers for such systems.

BACKGROUND AND SUMMARY OF THE INVENTION

In hydraulic systems utilizing hydraulic valves for controlling the flow to an actuator such as a cylinder, it is conventional to utilize controllers which are actuated by fluid at pilot pressure to control the movement and flow to and from hydraulic valves.

The present invention is directed to an electrically controlled hydraulic remote controller which can be remotely controlled and which will function by an electrical signal from a remote source to control flow of pilot pressure to not only move the hydraulic valve into a position for operating the actuator but also control the flow of pilot fluid out of the hydraulic valve to increase the speed of response of the hydraulic valve so that the actuator which is being operated will move more quickly.

In accordance with the invention, the electrically controlled hydraulic remote controller for use in piloting the operating of a hydraulic control valve comprises a pair of electrically operated three-way pressure control valves. Each control valve has a supply pressure inlet and a controlled pressure outlet operable in the de-energized position to prevent flow from the supply inlet to the controlled pressure outlet and connect the outlet to tank. The valve when energized is operable to permit fluid to flow from the inlet to the controlled pressure outlet, the pressure at the outlet being proportional to the electrical current operating the valve and simultaneously permitting fluid to flow to tank. The system includes means responsive to the higher of the controlled pressures at the outlets of the two pressure control valves for applying the higher controlled pressure to the control valve having the lower controlled pressure to operate the valve having the lower controlled pressure in a direction increasing the passage of fluid from a hydraulic valve being controlled through the valve having lower controlled pressure to tank.

DESCRIPTION

Figure 1:
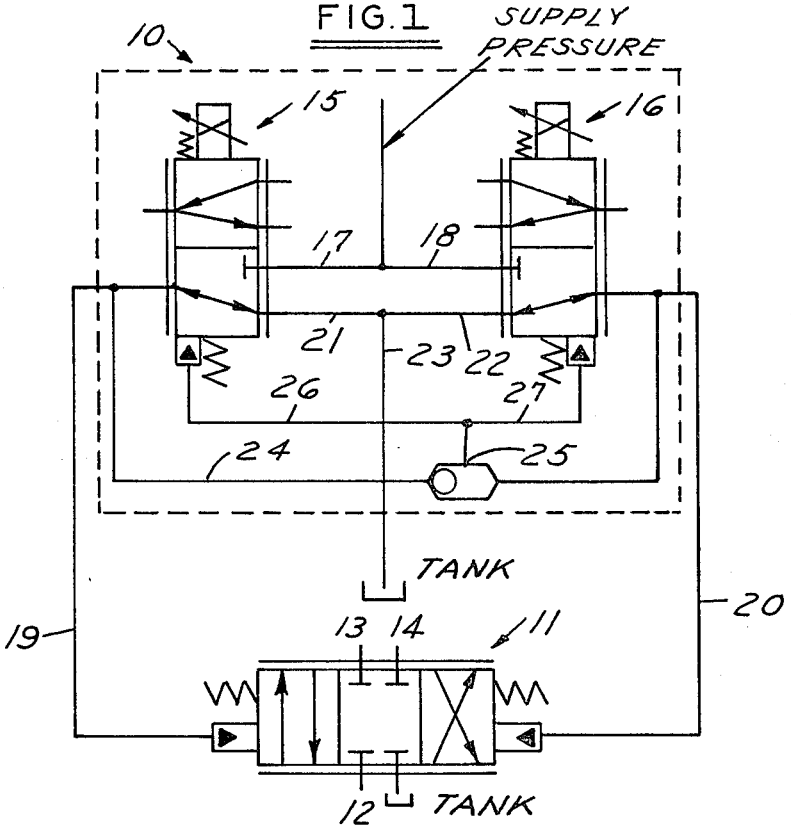
FIG. 1 is a symbolic diagram of a hydraulic system embodying the invention.

Referring to FIG. 1, the hydraulic system includes an electrically controlled hydraulic remote controller 10 embodying the invention for controlling, for example, the operation of a conventional infinite positioning directional valve 11 which functions to apply pressure from a high pressure inlet 12 to lines 13, 14 and, in turn, to an actuator such as cylinder, not shown.

Controller 10 comprises a pair of identical electrically operated three-way valves 15, 16 which have pilot pressure supply inlets 17, 18 and controlled pilot pressure outlets 19, 20 extending to opposite ends of the directional valve 11.

In the de-energized or normal position, each valve 15, 16 prevents flow from the respective inlets 17, 18 to the controlled pressure outlets 19, 20 but permits communication of pilot fluid from valve 11 to tank through lines 21, 22 and 23. When one or the other of the valves 15, 16 is energized, the valve shifts to provide flow of pilot fluid through a controlled pressure line 19 or 20 as well as to the tank, the pressure level of the fluid is proportional to the force generated by the solenoid.

Means are provided for sensing the greater of two pressures in the outlet pressure lines 19, 20 and applying that pressure to the valve 15 or 16 having the lower pressure in a direction to move that valve so that the flow of pilot fluid out of the directional valve 11 through that valve to tank is facilitated, that is, minimum restriction is provided. The greater of two pressures is also applied the valve having the higher pressure. Such means comprises a line 24 having a shuttle valve 25 communicating with lines 26, 27 extending to the valves 15, 16 so that the greater of the two pressures in the controlled pressure outlets 19, 20 is applied to the valves.

Figure 2:
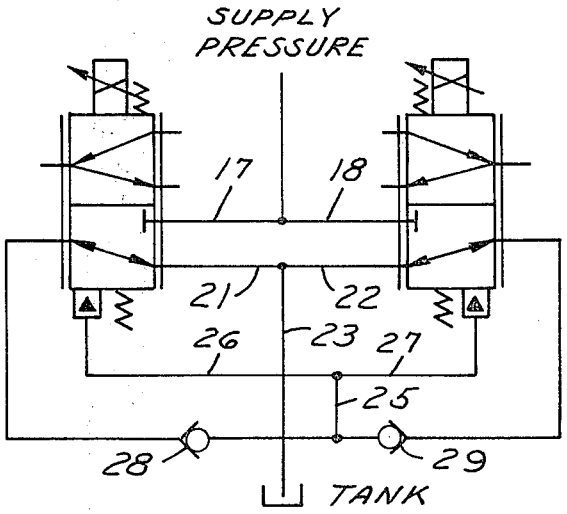
FIG. 2 is a symbolic diagram of a modified form of controller utilized in the system.

In the form of the controller shown in FIG. 2, the means for sensing the greater of the two pressures comprises a check valve 28, 29 for each valve.

Figure 3:
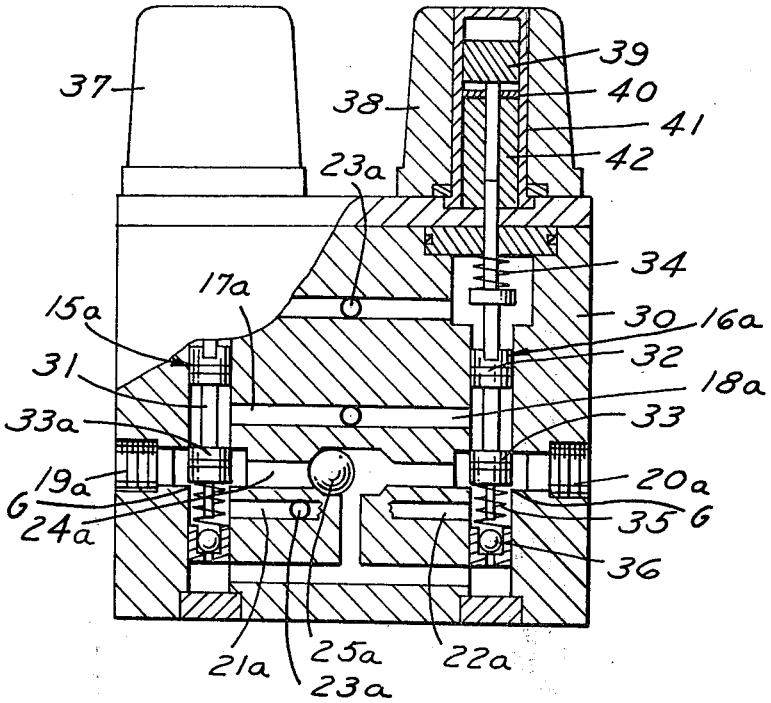
FIG. 3 is a part sectional view of an electrically controlled hydraulic remote controller.

A preferred form of the electrically controlled hydraulic remote controller is shown in FIG. 3 wherein corresponding portions are designated that the suffix "a".

As shown in FIG. 3, three-way valves 15*a*, 16*a* are mounted in a single body 30. Each valve has a spool 31, 32 operating in a bore and having a land 33 for controlling flow to controlled pressure outlets 19*a*, 20*a*. Each spool 31, 32 terminates in a stem portion adapted for contact with a ball 36 positioned in the lower end of the bore. Springs 34, 35 hold each spool in a centered position normally preventing flow from the supply pressure lines to the controlled pressure outlets. In this position, each land 33 is positioned so that there is a gap or underlap G permitting communication between the respective pressure outlets and the area beneath the lands that extends to tank pressure.

Solenoids 37, 38 are provided for energizing selectively the respective spools. Each solenoid includes an armature 39, a non-magnetic spacer 40, core tube 41 and pole piece 42.

In order to utilize controller 10 with variations in pilot pressures encountered in different hydraulic systems either or both ball 36 and spacer 40 are removable and replaceable with balls of different diameters and spacers of different thicknesses.

Changing ball 36 functions to increase or decrease the area subject to control pressure. That is, a smaller diameter ball being used in systems with high control pressure and a larger diameter ball being used with low control pressure systems.

Changing spacer 40 functions to increase or decrease the length of stroke and therefore the force applied by armature 39 to the valve spool without changing current requirements of the solenoids. Decreasing the thickness of spacer 40 allows use of controller 10 in high control pressure systems and increasing the spacer allows use of the controller in low control pressure systems.

With a change in spacer thickness a change is required in the spool gap G to correspond with the changes in the stroke of armature 39.

In operation, as the current is applied to the solenoid of one valve, for example, valve 16*a*, the force exerted on the push pin on the respective spool 32 is increased causing the spool 32 to move creating an orifice between the supply line and the respective control line 20*a*. As the control pressure rises, the shuttle valve 25*a* shifts connecting the controlled pressure to the spool of the other valve 15*a* in a direction to move the spool 32 of the other valve 15*a* opening further the gap G of the other valve creating a large orifice between line 19*a* and tank. The spool 32 of valve 16*a* reaches an equilibrium under the influence of the solenoid force, the control pressure in line 20*a* times the cross sectional area of the ball 36 and the forces of centering springs 34, 35. In the equilibrium state, the pressure in line 20*a* is proportional to the solenoid force.

The application of the pressure to the other spool 32 of valve 15*a* in a direction to increase the orifice to tank facilitates the return flow of pilot fluid from the directional valve through the other valve 15*a* to tank. This results in a more rapid response which, in turn, results in increasing the rate of movement of the actuator being controlled by the directional valve 11.

Figure 4:
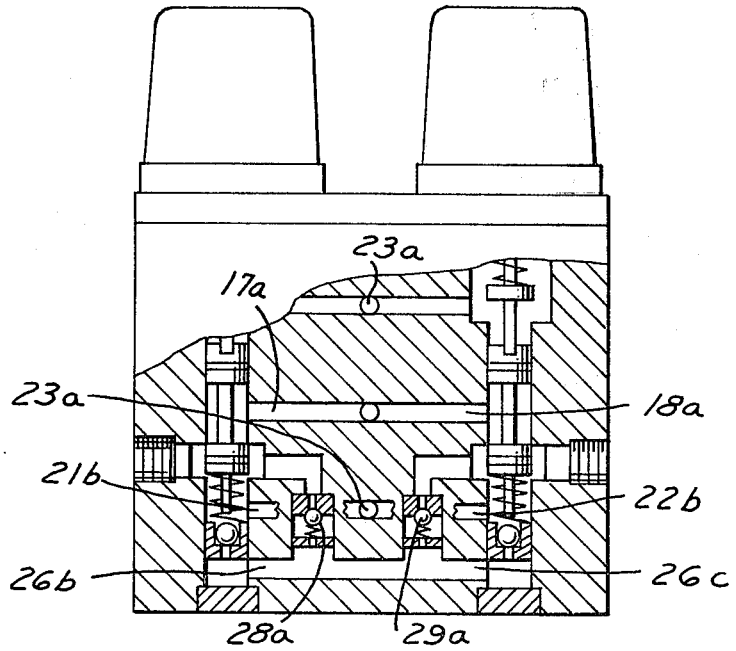
FIG. 4 is a part sectional view of a modified form of controller.

In the form shown in FIG. 4, the shuttle valve 25*a* is replaced by check valves 28*a*, 29*a* for sensing the greater of the pressures in the outlet pressure lines 19*a*, 20*a*.

I claim:

1. An electrically controlled hydraulic remote controller for use in piloting the operation of a hydraulic control valve comprising a pair of electrically operated three-way pressure control valves, each control valve having a supply pressure inlet and a controlled pressure outlet operable in the de-energized position to prevent flow from said supply inlet to said controlled pressure outlet and connect said outlet to tank, each said valve when energized being operable to permit fluid to flow from the inlet to the controlled pressure outlet, the pressure at said outlet being proportional to the electrical current operating said valve and simultaneously permitting fluid to flow to tank, means responsive to the higher of the controlled pressures of the outlets of the two pressure control valves for applying the higher controlled pressure to the valve having the lower controlled pressure to operate the valve having the lower controlled pressure in a direction increasing the passage of fluid through the said valve to tank.

2. The electrically controlled hydraulic remote controller set forth in claim 1 wherein said last-mentioned responsive means comprises a shuttle valve connecting to the controlled pressure outlets of said valves and operable to permit flow from the higher of the two controlled pressures in the outlets to the valve having the lower controlled pressure to operate said valve in a direction increasing the passage of fluid through said valve to tank.

3. The electrically controlled hydraulic remote controller set forth in claim 1 wherein said last-mentioned means comprises a check valve for each valve connected to each controlled pressure outlet of each valve and normally interrupting flow from said valve to tank.

4. The electrically controlled hydraulic remote controller set forth in any of claims 1–3 wherein each said valve comprises a spool normally positioned when the valve is de-energized to interrupt flow from the supply pressure to the respective controlled pressure outlet, said valve being centered in said position by springs.

5. The electrically controlled hydraulic remote controller set forth in claim 4 and a directional valve connected to said outlets of said controller and said directional valve being operable to control flow of fluid from a pressure source to an actuator.

6. An electrically controlled hydraulic remote controller comprising a body, a pair of valves in said body, a solenoid mounted on said body for each of said valves, each said valve comprising a spool, said body having a pilot supply pressure inlet and a controlled pressure outlet, said spool being positioned such that when the solenoid is de-energized, fluid is prevented from flowing from the supply pressure inlet to the controlled pressure outlet and said respective controlled pressure outlet is connected to tank pressure through a tank pressure passage, said spool being positioned when the solenoid is energized to permit fluid to flow from said supply pressure inlet to the controlled pressure outlet, and means responsive to the higher of the controlled pressures of the outlets of the two pressure controlled valves for applying the higher controlled pressure to the valve having the lower controlled pressure to operate the valve in a direction increasing the passage of fluid through the other valve to tank.

7. The electrically controlled hydraulic remote controller set forth in claim 6 wherein said last-mentioned responsive means comprises a shuttle valve connected to the controlled pressure outlet of each said valve and operable to permit flow from the higher of the two controlled pressures in the outlets to tank.

8. The electrically controlled hydraulic remote controller set forth in claim 6 wherein said last-mentioned means comprises a check valve for each valve connected to each controlled pressure outlet of each valve and normally interrupting flow from said valve to tank.

9. The electrically controlled hydraulic remote controller set forth in claim 6, 7 or 8 and a directional valve connected to said outlets of said controller and operable to control flow of fluid from a pressure source to an actuator.

10. The electrically controlled hydraulic remote controller set forth in any of claim 9 wherein each solenoid comprises an armature, a removable and replaceable spacer, a core tube and a pole piece.

11. A hydraulic remote controller for use in piloting the operation of a hydraulic control valve comprising a pair of selectively operated three-way pressure control valves, each control valve having a supply pressure inlet and a controlled pressure outlet and being operable in the normal position to prevent flow from said supply inlet to said controlled pressure outlet and connect said outlet to tank, each said valve being operable to permit fluid to flow from the inlet to the controlled pressure outlet, the pressure at said outlet being proportional to the force operating said valve and simultaneously permitting fluid to flow to tank, means responsive to the higher of the controlled pressures of the outlets of the two pressure controlled valves for applying the higher controlled pressure to the valve having the lower controlled pressure to operate the valve having the lower controlled pressure in direction increasing the passage of fluid through the other valve to tank.

12. The hydraulic remote controller set forth in claim 11 wherein said last-mentioned responsive means comprises a shuttle valve connected to the controlled pressure outlet of each said valve and operable to permit flow from the higher of the two controlled pressures in the outlets to the valve having the lower controlled pressure to operate said valve in a direction increasing the passage of fluid through said valve to tank.

13. The hydraulic remote controller set forth in claim 11 wherein said last-mentioned means comprises a check valve connected to each controlled pressure outlet of each valve and normally interrupting flow from said valve to tank.

14. The hydraulic remote controller set forth in any of claim 11, 12 or 13 wherein each said valve comprises a spool normally positioned when the valve is in normal position to interrupt flow from the supply pressure to the respective controlled pressure outlet, said valve being centered in said normal position by springs.

15. The hydraulic remote controller set forth in claim 14 and a directional valve connected to said outlets of said controller and operable to control flow of fluid from a pressure source to an actuator.

16. A hydraulic remote controller comprising a body, a pair of valves in said body, each said valve comprising a spool, said body having a pilot supply pressure inlet and a controlled pressure outlet, said spool being normally positioned such that fluid is prevented from flowing from the supply pressure inlet to the controlled pressure outlet, the spool when in normal position connecting said respective controlled pressure outlet to tank pressure through a tank pressure passage, said spool when moved from said normal position permitting fluid to flow from said supply pressure inlet to said controlled pressure outlet, and means responsive to the higher of the controlled pressures of the outlets of the two pressure controlled valves for applying the higher controlled pressure to the valve having the lower controlled pressure to operate the valve in a direction increasing the passage of fluid through the other valve to tank.

17. The hydraulic remote controller set forth in claim 16 wherein said last-mentioned responsive means comprises a shuttle valve connected to the controlled pressure outlet of each said valve and operable to permit flow from the higher of the two controlled pressures in the outlets to tank.

18. The hydraulic remote controller set forth in claim 16 wherein said last-mentioned means comprises a check valve connected to each controlled pressure outlet of each valve and normally interrupting flow therefrom to tank.

19. The hydraulic remote controller set forth in claim 16, 17 or 18 and a directional valve connected to said outlets of said controller and operable to control flow of fluid from a pressure source to an actuator.

20. The hydraulic remote controller set forth in claim 19 wherein the higher of the controlled pressures is also applied to the valve having the higher controlled pressure to tend to operate the valve in a direction toward said normal position.

* * * * *